United States Patent [19]

Wilbur et al.

[11] Patent Number: 5,029,504

[45] Date of Patent: Jul. 9, 1991

[54] SELF-CLEANING CUTTER KNIFE FOR USE IN PRODUCT INSPECTION AND CUTTING APPARATUS

[75] Inventors: John H. Wilbur, Medford; Gale M. Wood, Klamath Falls, both of Oreg.

[73] Assignee: Simco/Ramic Corporation, Medford, Oreg.

[21] Appl. No.: 532,320

[22] Filed: Jun. 1, 1990

[51] Int. Cl.[5] ..... B26D 1/62

[52] U.S. Cl. ..... 83/168; 83/337; 83/578; 83/697

[58] Field of Search ..... 83/111, 113, 168, 303, 83/337, 578, 663, 697; 234/50

[56] References Cited

U.S. PATENT DOCUMENTS 3,693,335 9/1972 Mathews ..... 56/12.7

4,520,702 5/1985 Davis et al. ..... 83/71

*Primary Examiner*—Douglas D. Watts

*Assistant Examiner*—Kenneth E. Peterson

*Attorney, Agent, or Firm*—Stoel Rives Boley Jones & Grey

[57] ABSTRACT

A self-cleaning cutter knife (100) is described for use as a replacement for prior art cutter knives in product inspection and cutting apparatus having a cutting wheel assembly including a knife guide having angularly spaced radially oriented knife support slots through which cutter knives having tangs extending therefrom move between a retracted noncutting position and an extended cutting position. The self-cleaning cutter knife (100) includes a shank (102) and a tang (114) similar to those of prior art cutter knife (10) but also includes a secondary blade (126) whose cutting edge (128) is positioned to cut product remnants adhering to the shank (102) as it retracts into the cutting wheel assembly. The secondary blade (126) diminishes the knife jamming that results from accumulation of large product remnants in the cutting wheel assembly knife slots.

18 Claims, 4 Drawing Sheets

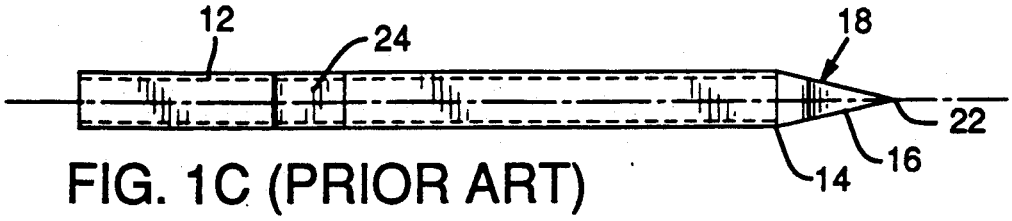
FIG. 1C (PRIOR ART)
FIG. 1B (PRIOR ART)
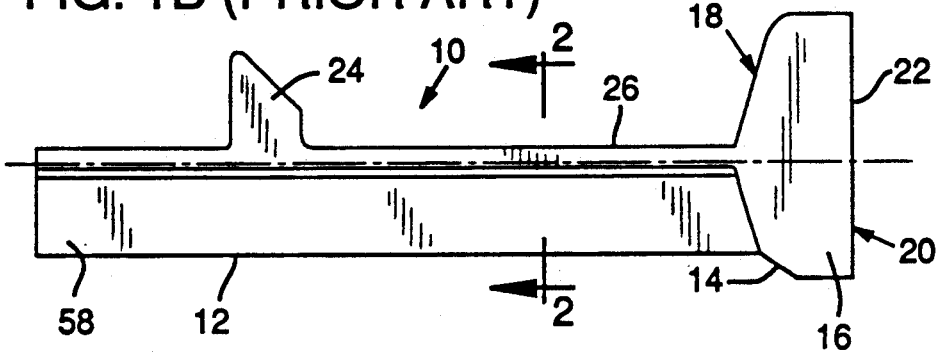
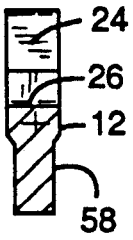
FIG. 2 (PRIOR ART)
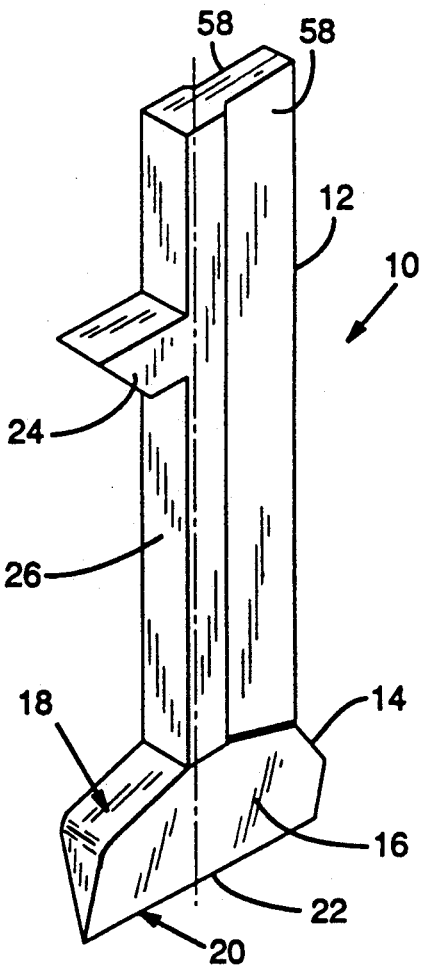
FIG. 1A (PRIOR ART)

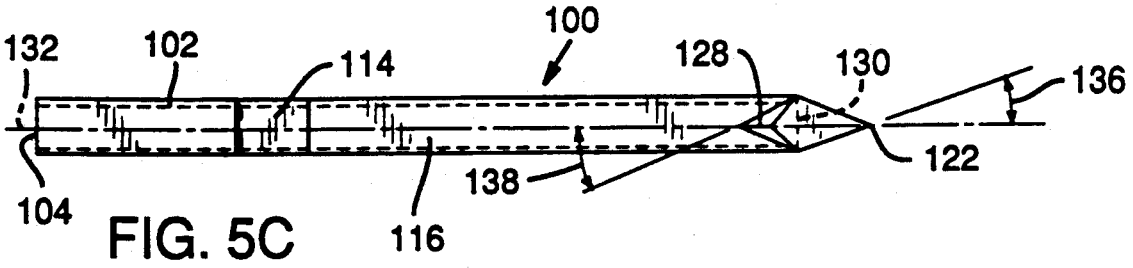
FIG. 5C
FIG. 5B
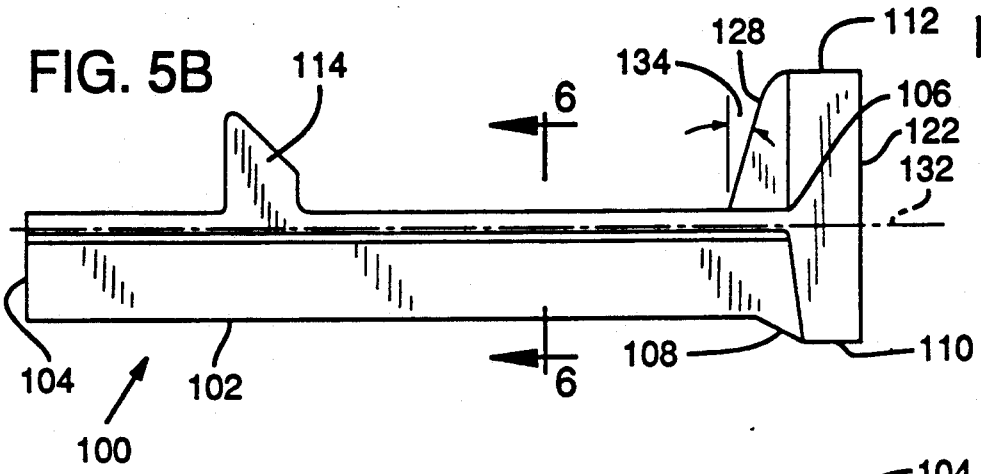
FIG. 6
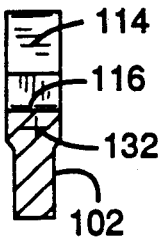
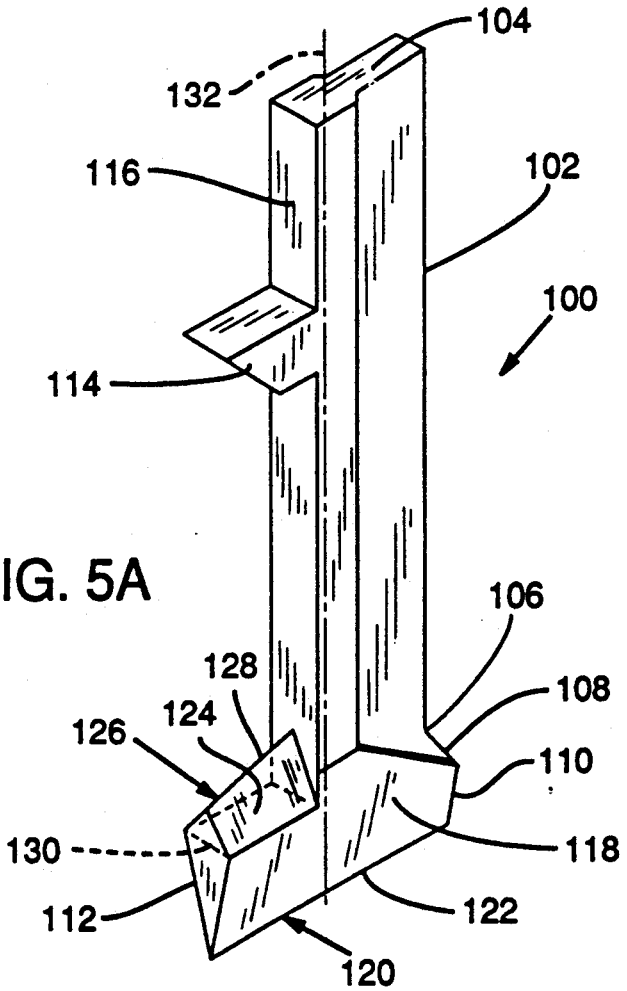
FIG. 5A

SELF-CLEANING CUTTER KNIFE FOR USE IN PRODUCT INSPECTION AND CUTTING APPARATUS

TECHNICAL FIELD

The present invention relates to product inspection and cutting apparatus and, in particular, to a self-cleaning cutter knife for use in such apparatus.

BACKGROUND OF THE INVENTION

High-speed product inspection and cutting apparatus that include an inspection station for detecting defects in a specimen product and a cutting station for removing the defects are in widespread use in the processed food industry. One such type of inspection and cutting apparatus is described in U.S. Pat. No. 4,520,702 of Davis et al., the subject matter of which is herein incorporated by reference.

An apparatus of the Davis et al. type uses a rotating cutting wheel assembly that carries multiple plastic cutter knives angularly spaced around the periphery of a knife support ring or knife guide. A conveyor belt carries previously inspected product material, such as elongated potato strips, carrots, green beans, or other food articles, in a direction generally orthogonal to the axis of rotation of the cutting wheel assembly, which is mounted overhead the conveyor belt. The cutting wheel assembly, in response to commands delivered from an inspection station, selectively deploys certain cutter knives radially outwardly through slots in the knife guide to excise defective regions from the product as it appears directly below the cutting wheel assembly. Having cut the product, the selected knives retract into their respective knife support ring slots until the knives are again deployed.

FIGS. 1A, 1B, and 1C and FIG. 2 are respective isometric, side elevation, top, and sectional views of a prior art cutter knife 10 of a type that can be used in the Davis et al. cutting wheel assembly. Cutter knife 10 includes an elongated shank 12 terminating in a foot 14, thereby giving cutter knife 10 the shape of a leg. A wedge-shaped blade 16 has an inclined, flat top 18 and a bottom 20 from which a cutting edge 22 outwardly extends. A tang 24 that extends from a slide surface 26 of shank 12 is sized to fit in and slide between an inner annular track 28 and an outer annular track 30 of a cam track structure 32, which is shown in FIG. 3.

With reference to FIG. 3, inner annular track 28 and outer annular track 30 receive the tangs 24 of the cutter knives 10 when they are in a retracted noncutting position 34 and an extended cutting position 36, respectively. A knife gate mechanism 38 guides tangs 24 into the track specified by the inspection station (not shown). In FIG. 3, a representative number of the cutter knives 10 are shown in a retracted noncutting position 34, and a representative number of the cutter knives 10 are shown in an extended cutting position 36.

FIG. 4 is a side elevation view of a circular knife guide 50 that has positioned back-to-back and around its periphery two rings of slots 52 each of which holds a cutter knife 10. Each ring of slots 52 of knife guide 50 fits over a different stationary cam track structure 32 and imparts rotational motion to cutter knives 10 so that they slide along cam track structure 32 in either one of its annular tracks 28 and 30. The axis of rotation 54 of knife guide 50 is coincident with the center point 56 of annular tracks 28 and 30. Each one of slots 52 holds and guides a cutter knife 10 as it moves radially between retracted noncutting position 36 and extended cutting position 38. A recessed area 58 along the side walls of shank 12 allows a liquid lubricant to flow between knife 10 and the sides of slots 52 to reduce the stiction forces between them.

One problem with the above-described cutting wheel assembly is that cutter knife 10 occasionally sticks in its slot 52 when remnant product pieces adhere to the cutter knife. There is, therefore, a need for a solution to this problem.

SUMMARY OF THE INVENTION

The present invention is a self-cleaning cutter knife that may be used as a replacement for prior art cutter knife 10 in an inspection and cutting apparatus of the type described by Davis et al. The self-cleaning cutter knife includes a shank and a tang similar to those of cutter knife 10, but also includes a secondary blade whose cutting edge is positioned to cut product remnants adhering to the shank as it retracts into its knife guide slot in the cutting wheel assembly. The secondary blade greatly diminishes the occurrence of knife jamming that results from accumulation of large product remnants in the knife guide slots.

An object of the present invention is, therefore, to provide improved cutting knives for use in high-speed product inspection and cutting apparatus.

Another object of the invention is to provide improved cutting knives as replacement part cutting knives for use in high-speed product inspection and cutting apparatus.

A further object of the present invention is to provide cutter knives that are self-cleaning.

Still another object of the present invention is to provide cutter knives having a decreased occurrence of knife jamming resulting from the accumulation of product remnants on the knives.

Additional objects and advantages of the present invention will be apparent from the detailed description of a preferred embodiment thereof, which proceeds with reference to the accompanying drawings.

BRIEF DESCRIPTION OF THE DRAWINGS

FIGS. 1A, 1B, and 1C are respective isometric, side elevation, and top views of a prior art cutter knife.

FIG. 2 is a sectional view taken on lines 2—2 of FIG. 1B.

FIGS. 5A, 5B, and 5C are respective isometric, side elevation, and top views of a self-cleaning cutter knife of the present invention.

FIG. 6 is a sectional view taken along lines 6—6 of FIG. 5B.

DETAILED DESCRIPTION OF PREFERRED EMBODIMENT

Figure 4:
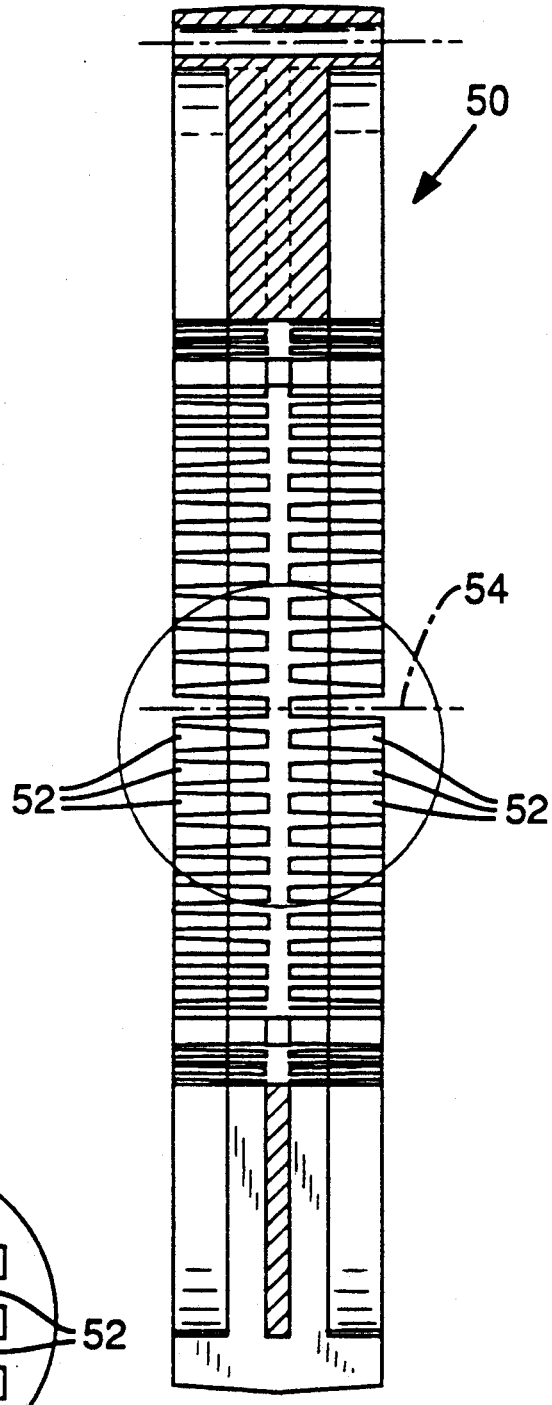
FIG. 4 (PRIOR ART)
FIG. 4 is a side view with a magnified portion of a prior art knife guide that supports and imparts rotational motion to the cutter knives so that they slide along the cam track structure of FIG. 3 in either one of its inner or outer annular tracks.
Figure 4:
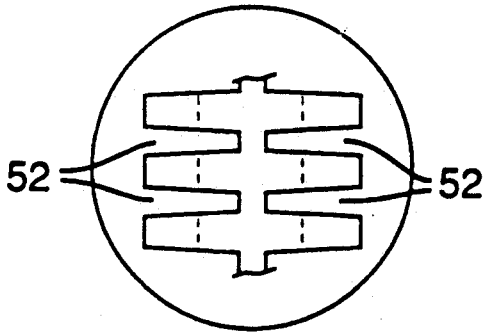
FIG. 4′ (PRIOR ART)
Figure 3:
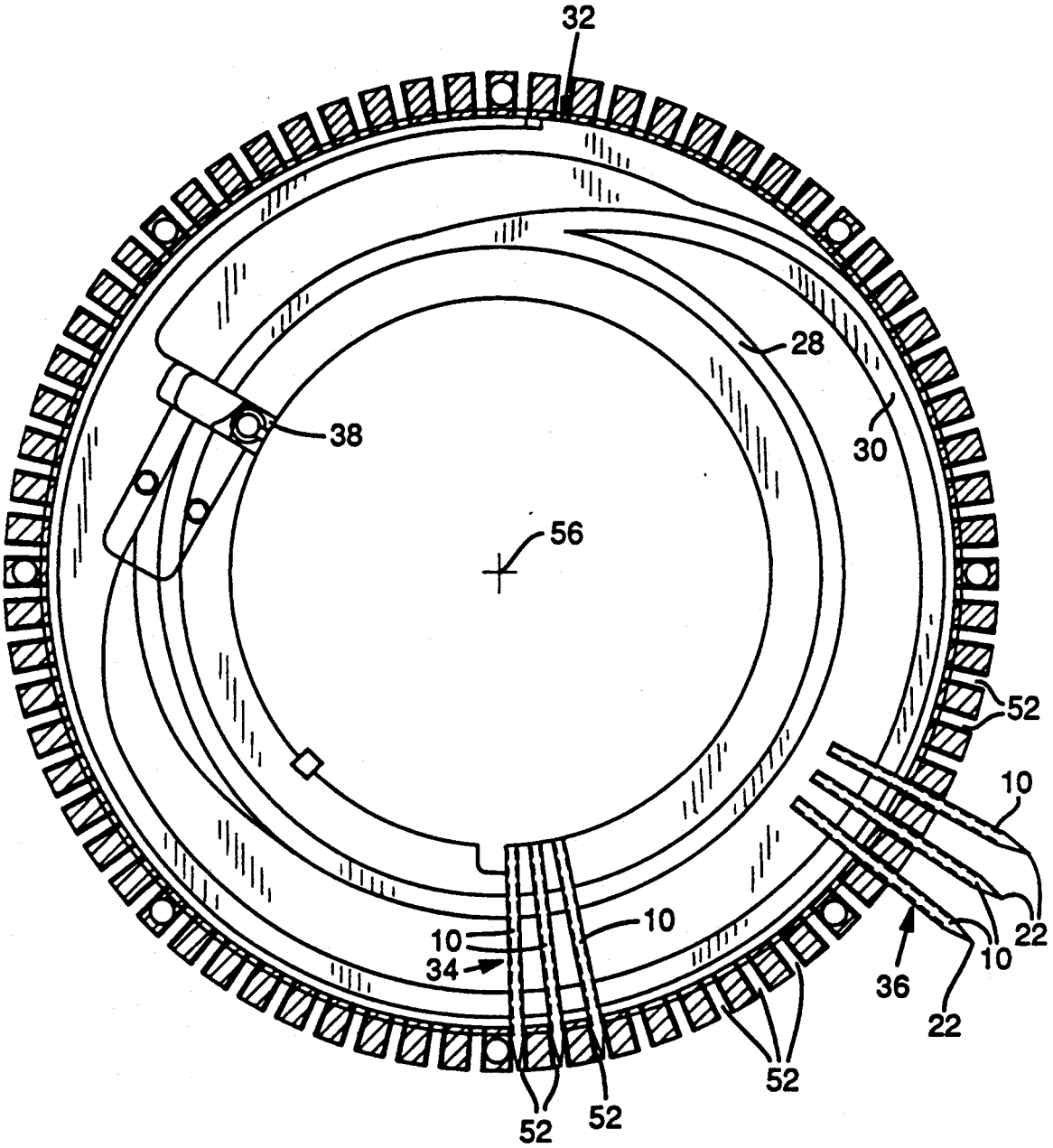
FIG. 3 (PRIOR ART)
FIG. 3 is a top view of a prior art knife guide shown in cross section encircling a cam track structure that has inner and outer annular tracks along which multiple cutter knives slide selectively between a retracted noncutting position and an extended cutting position, respectively.

With reference to FIGS. 5A, 5B, and 5C and FIG. 6, self-cleaning cutter knife 100 of the present invention includes an elongated shank 102 having a distal end 104 and an end 106 terminating with a foot 108 having a heel end 110 and a toe end 112. Shank 102 is positioned close to heel end 110, thereby giving cutter knife 100 the shape of a leg. A tang 114 that extends from a slide surface 116 of shank 102 at a position about one-third the distance from distal end 104 to end 106 is sized to fit in and slide between inner track 28 and outer track 30 of cam track structure 32, as was previously described.

Foot 108 includes a bottom 118 from which projects a primary blade 120 having a cutting edge 122 extending outwardly of bottom 118 and a top 124 from which projects a secondary blade 126 having a cutting edge 128 extending outwardly of top 124. Primary and secondary blades 120 and 126 are of wedge shapes, tapering from a common base 130 to their respective cutting edges 122 and 128, which are preferably coplanar (FIGS. 5A and 5C).

Cutting edge 122 of primary blade 120 defines a straight line disposed generally perpendicular to central longitudinal axis 132 of shank 102 and extends between heel end 110 and toe end 112 of foot 108. Cutting edge 128 of secondary blade 126 is inclined at an angle 134 of about 15 degrees relative to cutting edge 122 and extends between end 106 of shank 102 and toe end 112 of foot 108. Secondary blade 126 forms, therefore, a web structure between shank 102 and toe end 112 of foot 108.

With particular reference to FIG. 5C, primary and secondary blades 120 and 126 define back-to-back wedges having common base 130 and side surfaces tapering uniformly to apexes formed by the respective cutting edges 122 and 128. Each of the side surfaces of primary blade 120 inclines at an angle 136 of about 20 degrees relative to axis 132. Each of the side surfaces of secondary blade 126 inclines at an angle 138 of about 23 degrees relative to axis 132.

In operation, primary blade 120 cuts product presented to it when cutter knife 100 is deployed in an extended cutting position. Secondary blade 126 severs product remnants lying on slide surface 116, top 124, and secondary blade 126 of foot 108 as cutter knife 100 returns to a retracted noncutting position. Severing the product remnants prevents the jamming of cutter knife 100 with such remnants in its corresponding slot 52 in knife guide 50 of the cutting wheel assembly.

The use of primary blade 120 and secondary blade 126, as described above, facilitates the use of a steeper cutting angle 136 than typical of prior art cutting knives. Prior art cutting knives typically have cutting angles of around 10 degrees. A steeper angle causes cutter knife 100 to act as a splitting wedge and induces the product remnants to slide off the knife blade.

It will be obvious to those having skill in the art that many changes may be made to the details of the above-described preferred embodiment of the present invention without departing from the underlying principles thereof. The scope of the present invention should, therefore, be determined only by the following claims.

We claim:

1. In a product inspection and cutting apparatus comprising a cutting wheel assembly that includes a knife guide having angularly spaced radially oriented knife support slots through which cutter knives having tangs extending therefrom move between a retracted noncutting position and an extended cutting position and that further includes a cam track structure to which the knife guide is mountable for relative rotation and having inner and outer annular tracks receiving the tangs of the cutter knives when they are in the respective retracted noncutting and extended cutting positions, the improvement comprising:

self-cleaning cutter knives, each of which including an elongated shank terminating at one end thereof with a foot having a bottom and a top from which respective primary and secondary blades project, the primary blade having a cutting edge extending outwardly of the bottom of the foot and the secondary blade having a cutting edge extending outwardly of the top of the foot;

whereby the primary blade cuts product when a cutter knife is in the extended cutting position and the secondary blade cuts product remnants adhering to the top of the foot for the purpose of preventing jamming of the cutter knife with product in its corresponding slot in the knife guide as the knife returns from the extended cutting position to the retracted noncutting position.

2. The apparatus of claim 1 in which the shank has a longitudinal axis and the cutting edges of the primary and secondary blades lie in planes substantially parallel to the longitudinal axis.

3. The apparatus of claim 2 in which the planes are substantially coplanar.

4. The apparatus of claim 1 in which the shank has a slide surface from which the tang extends and a portion of the secondary blade extends from the slide surface.

5. The apparatus of claim 1 in which the secondary blade forms a structure between one end of the shank and the top of the foot.

6. The apparatus of claim 1 in which the primary blade is of wedge shape having an angle of inclination of about 20 degrees measured from the base of the wedge to the cutting edge thereof.

7. The apparatus of claim 1 in which the shank has a central longitudinal axis and the primary and secondary blades are of wedge shape and have different respective primary and secondary angles of inclination, the primary angle of inclination being measured from the central longitudinal axis to the cutting edge of the primary blade and the secondary angle of inclination being measured from the central longitudinal axis to the cutting edge of the secondary blade.

8. The apparatus of claim 7 in which the secondary angle of inclination is greater than the primary angle of inclination.

9. The apparatus of claim 1 in which the cutting edge of the primary blade defines a line disposed generally perpendicular to the length of the shank and the cutting edge of the secondary blade is inclined at an angle relative to the line.

10. The apparatus of claim 1 in which the foot has a toe end and a heel end and the shank is positioned on the top of the foot medially of the toe and heel ends, the cutting edge of the primary blade extending from the toe and heel ends and the cutting edge of the secondary blade extending between the shank and the toe end.

11. The apparatus of claim 10 in which the secondary blade forms a structure between the shank and the toe end.

12. A self-cleaning cutter knife, for use as a replacement cutter knife in product inspection and cutting apparatus having a cutting wheel assembly including a knife guide having angularly spaced radially oriented knife support slots through which cutter knives having tangs extending therefrom move between a retracted noncutting position and an extended cutting position, comprising:

an elongated shank terminating at one end thereof with a foot having a bottom and a top from which respective primary and secondary blades project;

the primary blade having a cutting edge extending outwardly of the bottom of the foot for cutting product when the cutter knife is in an extended cutting position; and the secondary blade having a cutting edge extending outwardly of the top of the foot for cutting product remnants adhering to the top of the foot for preventing jamming of the cutter knife as it returns from the extended cutting position to the retracted noncutting position.

13. The self-cleaning cutter knife of claim 12 in which the shank has a longitudinal axis and the cutting edges of the primary and secondary blades lie in planes substantially parallel to the longitudinal axis.

14. The self-cleaning cutter knife of claim 13 in which the planes are substantially coplanar.

15. The self-cleaning cutter knife of claim 12 in which the shank has a slide surface from which the tang extends and a portion of the secondary blade extends from the slide surface.

16. The self-cleaning cutter knife of claim 12 in which the primary blade is of wedge shape having an angle of inclination of about 20 degrees measured from the base of the wedge to the cutting edge thereof.

17. The self-cleaning cutter knife of claim 12 in which the shank has a central longitudinal axis and the primary and secondary blades are of wedge shape and have different respective primary and secondary angles of inclination, the primary angle of inclination being measured from the central longitudinal axis to the cutting edge of the primary blade and the secondary angle of inclination being measured from the central longitudinal axis to the cutting edge of the secondary blade.

18. The self-cleaning cutter knife of claim 12 in which the secondary angle of inclination is greater than the primary angle of inclination.

* * * * *